US006549831B2

(12) United States Patent
Thompson

(10) Patent No.: US 6,549,831 B2
(45) Date of Patent: Apr. 15, 2003

(54) RUDDER ANGLE INDICATOR SYSTEM WITH ACTIVE SECTOR SENSING

(75) Inventor: Eldon John Thompson, Ruckersville, VA (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/768,583

(22) Filed: Jan. 24, 2001

(65) Prior Publication Data

US 2002/0099480 A1 Jul. 25, 2002

(51) Int. Cl.[7] ..... B63M 25/36; B63H 9/00; B08B 21/00

(52) U.S. Cl. ..... 701/21; 701/14; 114/163; 340/987

(58) Field of Search ..... 701/21, 14, 224; 114/163, 162, 144 RE, 144 C, 144 R; 318/588, 591; 340/984, 987

(56) References Cited

U.S. PATENT DOCUMENTS 3,943,764 A * 3/1976 Greene ..... 73/178 R
4,038,528 A * 7/1977 Fowler ..... 235/150.26
4,069,784 A * 1/1978 Hedstrom et al. ..... 114/144 E
4,100,874 A * 7/1978 Wright ..... 114/162
4,129,087 A * 12/1978 Dimmick et al. ..... 114/144 E
4,140,075 A * 2/1979 Berkhan ..... 1144/150
4,223,624 A * 9/1980 Iyeta ..... 114/144 E
4,912,465 A * 3/1990 Greer ..... 340/987
5,107,424 A * 4/1992 Bird et al. ..... 364/424.01
5,361,024 A * 11/1994 Wisner et al. ..... 318/588
5,488,919 A * 2/1996 Ferreiro et al. ..... 114/122
6,308,649 B1 * 10/2001 Gedeon ..... 114/39.11
6,311,634 B1 * 11/2001 Ford et al. ..... 114/144 R

* cited by examiner

*Primary Examiner*—Tan Nguyen
*Assistant Examiner*—Dalena Tran
(74) *Attorney, Agent, or Firm*—Seymour Levine; Gerald L. Lett

(57) ABSTRACT

The rudder angle indicator system utilizes a low cost potentiometer coupled to the rudder to provide a signal proportional to rudder angle. A stepper motor positions, in open loop arrangement, the dial of a rudder angle indicator, such as a large three-faced rudder angle display, in accordance with the potentiometer signal. An active sector tab and sensor are utilized to provide a signal in accordance with when the indicator is in the active sector of the display so as to minimize the search for the indicator zero index tab.

29 Claims, 5 Drawing Sheets

RUDDER ANGLE INDICATOR SYSTEM WITH ACTIVE SECTOR SENSING

BACKGROUND OF THE INVENTION

1. Field of the Invention

The invention relates to indicator systems for marine vehicles particularly with respect to a low cost rudder angle indicator system including a large, three-faced display.

2. Description of the Prior Art

In one type of prior art rudder angle indicator system, a conventional synchro transmitter is coupled to the rudder to provide a synchro signal output in accordance with rudder angle. A conventional synchro receiver, coupled to a rudder angle indicator, positions the indicator to an angle in accordance with the synchro signal thereby displaying rudder angle. Plural synchro receivers may be required if multiple indicator units are utilized. Typical synchro transmitter and receiver devices tend to be expensive adversely affecting the cost competitiveness of a rudder angle indication system in which they are utilized.

It is often desirable and a requirement in certain types of installations to utilize a large conventional three-faced rudder angle indicator display as the primary rudder angle indicator, which display is typically mounted overhead in the bridge area. The large indicator is mounted toward the front and center of the bridge and by utilizing the three scales located at different angles around the indicator, the large dial can be read from numerous positions in the bridge area including straight on and from the port and starboard wings.

When the large three-faced indicator structure it utilized, the rudder angle sensor and indicator positioning mechanism is conventionally synchro based. In such systems, a number of smaller displays may be mounted in various locations about the ship and may also be included on the bridge wings. In such a synchro based system, a synchro receiver corresponding to the synchro transmitter rudder angle sensor is used to drive each of the indicator units including the three-faced display. Because of the significant cost of the synchro devices, such a synchro based system tends to be undesirably expensive as discussed above.

Another approach to rudder angle indication utilizes a potentiometer sensor coupled to the rudder to provide a voltage proportional to rudder angle. The rudder angle indicating voltage is applied to a plurality of d'arsonval meter movement indicators with appropriate rudder angle indication scales. Such an analog system tends to be inaccurate and unreliable and requires amplifiers in accordance with the number of such indicators utilized on the ship. Significantly, the d'arsonval meter movement approach is inappropriate for positioning the large three-faced rudder angle indicator without undesirable design complexity and expense. Thus, it is appreciated that this analog approach is primarily limited to providing variously positioned small meter movement indicators about the ship for displaying rudder angle.

U.S. Pat. No. 5,107,424 issued Apr. 21, 1992 and assigned to the assignee of the present invention, although not describing a rudder angle indication system, discloses, inter alia, a compass repeater dial positioned open loop by a stepper motor in response to a signal from a synchro coupled to the ship's compass. An index tab attached to a pulley driving the repeater dial provides an electrical index for positioning the repeater dial to zero. Although the system of said U.S. Pat. No. 5,107,424 is eminently suited to the purposes for which the system was designed, the use of an expensive synchro sensor would be undesirable in a system where the objective is low cost.

Additionally, at power-up of the system, a full 360° spin search of the repeater dial is typically required to locate the index tab for initial dial synchronization. A considerable amount of time is required for the full 360° repeater dial spin hunt for the index tab where the repeater dial is slewed potentially through 360° while detecting when the index tab traverses the index tab sensor. The time required for the search is further exacerbated by index tab overshoot and reverse direction hunting for the tab alignment edge.

It is an objective of the present invention to provide a low cost rudder angle indicator system suitable for driving the large three-faced rudder angle display.

It is a further objective of the invention to minimize the requirements of the full 360° spin search for the index tab during power-up of the system.

SUMMARY OF THE INVENTION

The objectives of the present invention are achieved by a system for providing an indication of rudder angle utilizing a position sensor, such as a low cost potentiometer, coupled to the rudder for providing a rudder angle signal. A display indicator, such as the three-faced rudder angle indicator, provides the rudder angle indication which is provided in an active display sector corresponding to the rudder angle range. Drive means, such as a stepper motor, drives the indicator open loop in response to the rudder angle signal so that the indicator provides the rudder angle indication. Initializing means including, for example, an index tab and sensor are utilized in activating the drive means to drive the indicator to an initial position such as 0°. If the indicator is already in the active sector, a first initializing procedure is utilized that avoids the disadvantages of a full spin search. If the indicator is not in the active sector, a second initializing procedure, such as the full spin search, is utilized. Means, which include, for example, a sector tab and sensor, are included for detecting the active sector of the display to provide an active sector signal in accordance with whether the indicator is or is not positioned in the active sector. The active sector signal is utilized to determine which of the first and second initializing procedures to select.

DESCRIPTION OF THE PREFERRED EMBODIMENT

Figure 1:
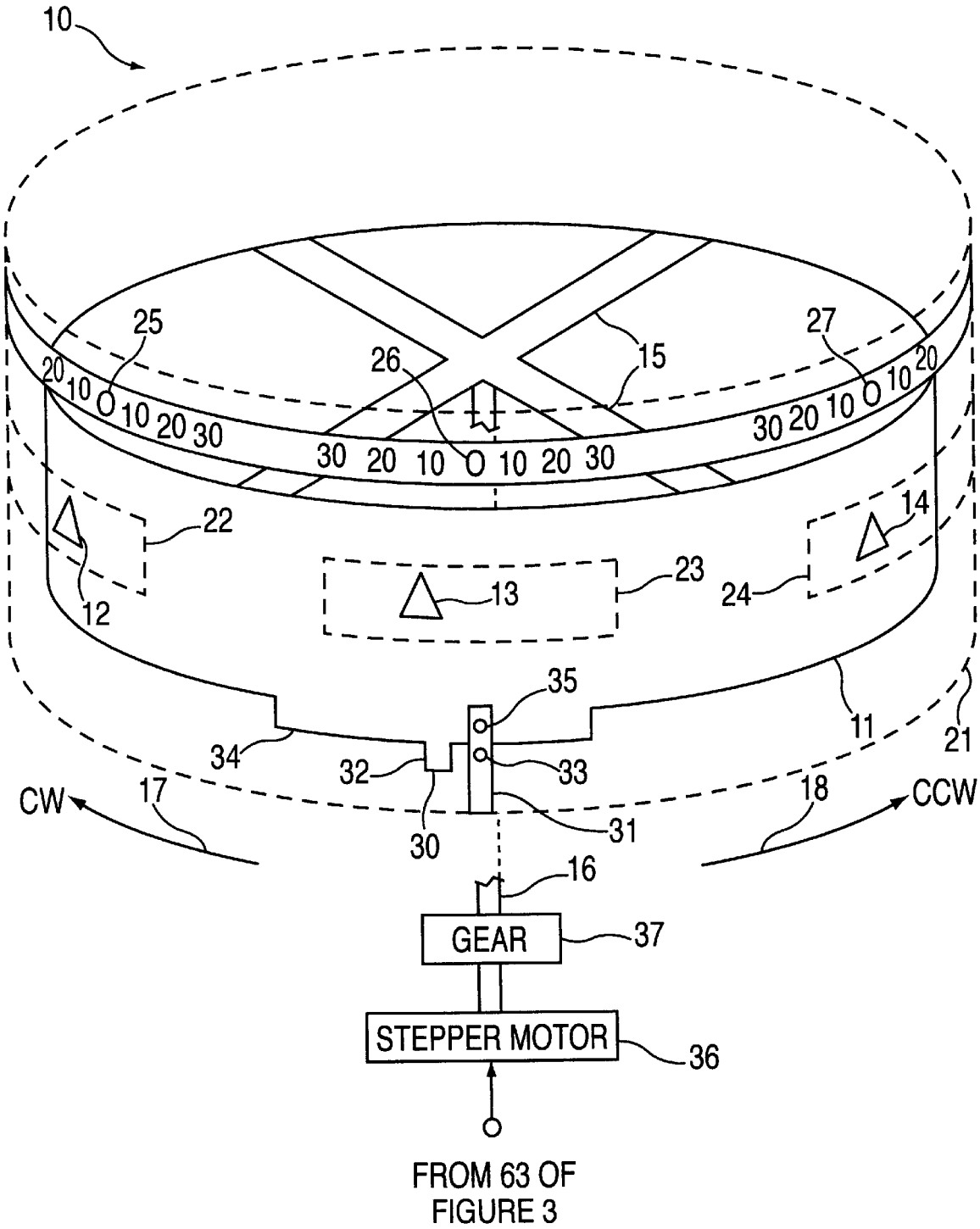
FIG. 1 is a representation of the large three-faced rudder angle indicator display preferably utilized in the present invention. The sector tab and sensor as well as the stepper motor aspect of the invention are also illustrated.

Referring to FIG. 1, a three-faced rudder angle indicator 10 includes a rotatable cylindrical structure 11. Three dial pointers 12–14 are disposed at separated angular sectors around the outer surface of the cylinder 11 which is supported for rotation about its axis by any suitable structure such as supports 15. An appropriate element, such as a shaft 16, is utilized to rotate the cylinder 11 either in a clockwise (CW) or counterclockwise (CCW) direction about its center of rotation as defined by arrows 17 and 18, respectively. The CW and CCW directions of rotation are as viewed from the top of the dial, looking down on the cylinder 11.

The cylinder 11 is disposed within a housing 21 (shown in phantom) having three view windows 22–24 through which the pointers 12–14, respectively, can be observed. Fixed with respect to the housing 21 are three rudder angle indicator dial scales 25–27 located with respect to the view windows 22–24, respectively. The scales 25–27 cooperate with the respective pointers 12–14 so as to provide three simultaneous indications of rudder angle through the respective view windows. The cylinder 11 and housing 21 are preferably constructed of plastic to provide low mass and low cost and to accommodate for lighting when viewed at night.

Located on the cylinder 11 is an index tab 30 that functions to block light in a low cost U-channel optical interrupter sensor assembly 31. The index tab 30 includes an alignment edge 32 that is aligned with the centerline of the pointer 13. The index tab 30 is sensed to determine the position of the cylinder 11 for initial alignment purposes in a manner to be described. The sensor assembly 31 includes an index tab sensor 33 for detecting the index tab 30.

Also located on the cylinder 11, in accordance with the invention, is an active sector tab 34 that demarcates the active sector area of the cylinder 11. The active sector tab 34 is sensed with the U-channel optical interrupter sensor assembly 31 utilizing an active sector tab sensor 35. The active sector tab 34 demarcates the active dial area by utilizing a tab width equal to the width of a rudder angle scale 25–27 (e.g. scale 26), with the tab 34 centered about the centerline of a pointer (e.g. pointer 13) and with the centerline of the optical sensor 35 aligned with the zero degree indicium of the scale (e.g. scale 26). The active sector tab 34 and the corresponding sensor 35 substantially obviate the requirement for a full 360° spin search to locate the index tab 30 during power-up in a manner to be described.

As discussed above, the large three-faced rudder angle indicator is conventionally driven by an expensive synchro device. In accordance with the invention, the cylinder 11 is driven, open loop, by a low cost stepper motor 36 in a manner to be described. The stepper motor 36 is coupled to the shaft 16 through a gear reduction assembly 37 to provide fine positioning of the dial to, for example, 0.1 degrees of resolution. The stepper motor 36 is preferably of the small, four-phase unipolar drive type which may be obtained from Thomson Airpax Mechatronics as part No.42M100B.

It is appreciated that the rudder angle markings on the scales 25–27 are illustrative, typical scale ranges being ±35° and ±45°. In practice, scale markings can be in the range of from ±35° to ±75°.

Although the tabs 30 and 34 and sensor assembly 31 are illustrated relative to the pointer 13 and the scale 26, it is appreciated that the tabs 30 and 34 may be located at any position on the cylinder 11 with the sensor assembly 31 similarly positioned. For example, these elements may be located toward the rear of the cylinder 11. Similarly, although the tabs 30 and 34 as well as the sensors 33 and 35 are illustrated collocated with respect to each other, it is appreciated that the index tab 30 and the sector tab 34 may be separately located with respect to each other on the cylinder 11. With this arrangement, separate index tab sensor and sector tab sensor assemblies would be similarly utilized and appropriately located in accordance with the respective tabs.

Although the pointers 12–14 are positioned on the rotatable cylinder 11 with the associated scales 25–27 fixed with respect to the housing 21, it is appreciated that, alternatively, the scales 25–27 may be disposed on the rotatable cylinder 11 with the corresponding pointers 12–14 fixed with respect to the housing 21. With this arrangement, the alignment edge 32 of the index tab 30 would be aligned with the zero degree rudder angle marking on the scale and the sensor assembly 31 would be aligned with the centerline of the fixed pointer.

Figure 1A:
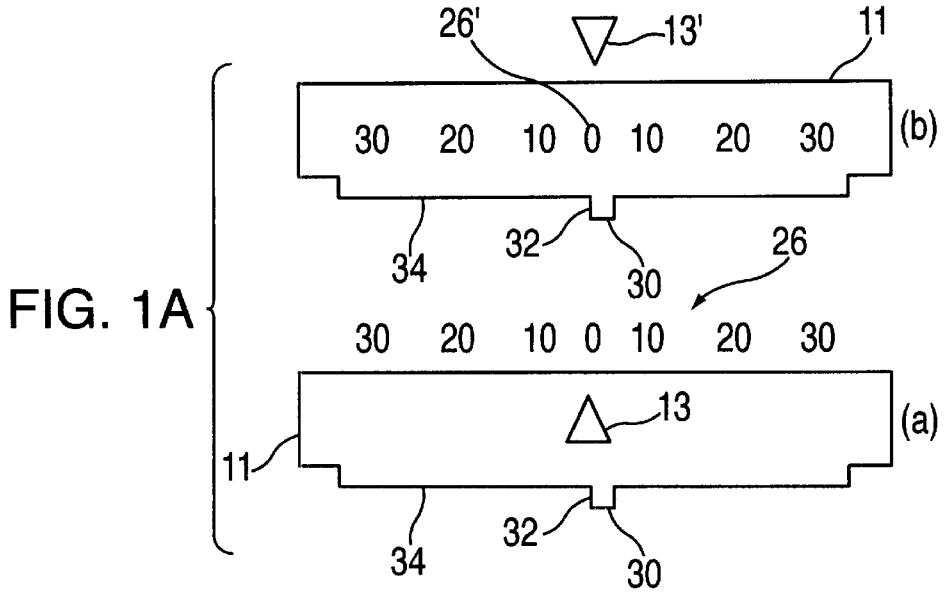
FIG. 1A is an edge view illustrating details of the rudder angle indicator display of FIG. 1 and an alternative arrangement thereof.

Referring to FIG. 1A, where like reference numerals indicate like elements with respect to FIG. 1 and with continued reference to FIG. 1, edge view (a) illustrates with further clarity the arrangement of the pointer 13, scale 26, and tabs 30 and 34 with respect to the cylinder 11. It is observed that the width of the sector tab 34 defines the active area of the cylinder 11 with respect to the rudder angle scales, such as the scale 26. Edge view (b) illustrate this detail with respect to the alternative arrangement of the disclosed embodiment of the invention. Primed reference numerals are used with respect to the pointer 13 and the scale 26 to distinguish that here the scale rotates and the pointer is fixed.

Figure 2:
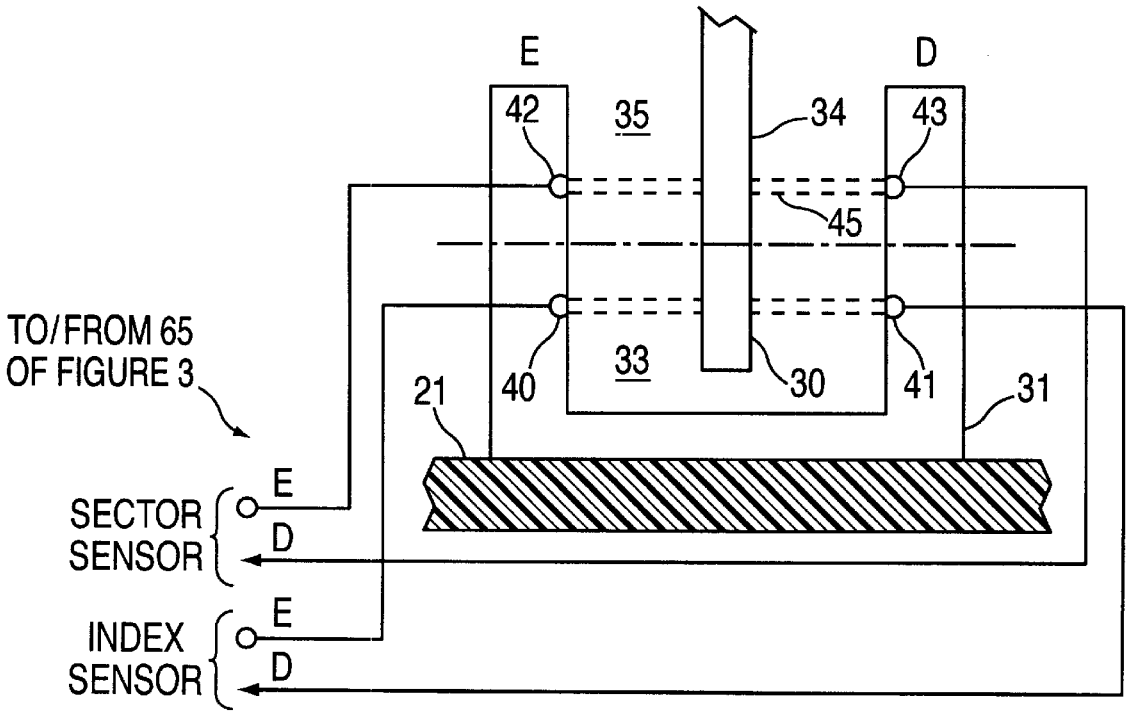
FIG. 2 is a representation of the sector tab and index tab optical interrupter sensors utilized in FIG. 1.

Referring to FIG. 2, in which like reference numerals indicate like elements with respect to FIG. 1, details of the U-channel optical interrupter sensor assembly 31 are illustrated. The index sensor 33 is comprised of a low cost emitter/detector pair comprised of an emitter 40 and a detector 41. A narrow slit (not shown) which may, for example, have a slit width of 1mm, is positioned in front of the optical detector 41 to improve the angular resolution of the sensor 33. The optical detector 41 may comprise a photo diode or photo transistor. In a similar manner, the active sector sensor 35 is comprised of an emitter 42 and a detector 43 and the descriptions given with respect to the sensor 33 apply thereto.

Each of the sensors 33 and 35 provides an on/off binary value to indicate when the associated tab 30 or 34 is blocking the sensor. Light rays 45 emitted from the emitters 40 and 42 are either received at or blocked from the detectors 41 and 43, respectively, in accordance with the positions of the tabs 30 and 34, respectively, located on the cylinder 11 (FIG. 1).

Figure 3:
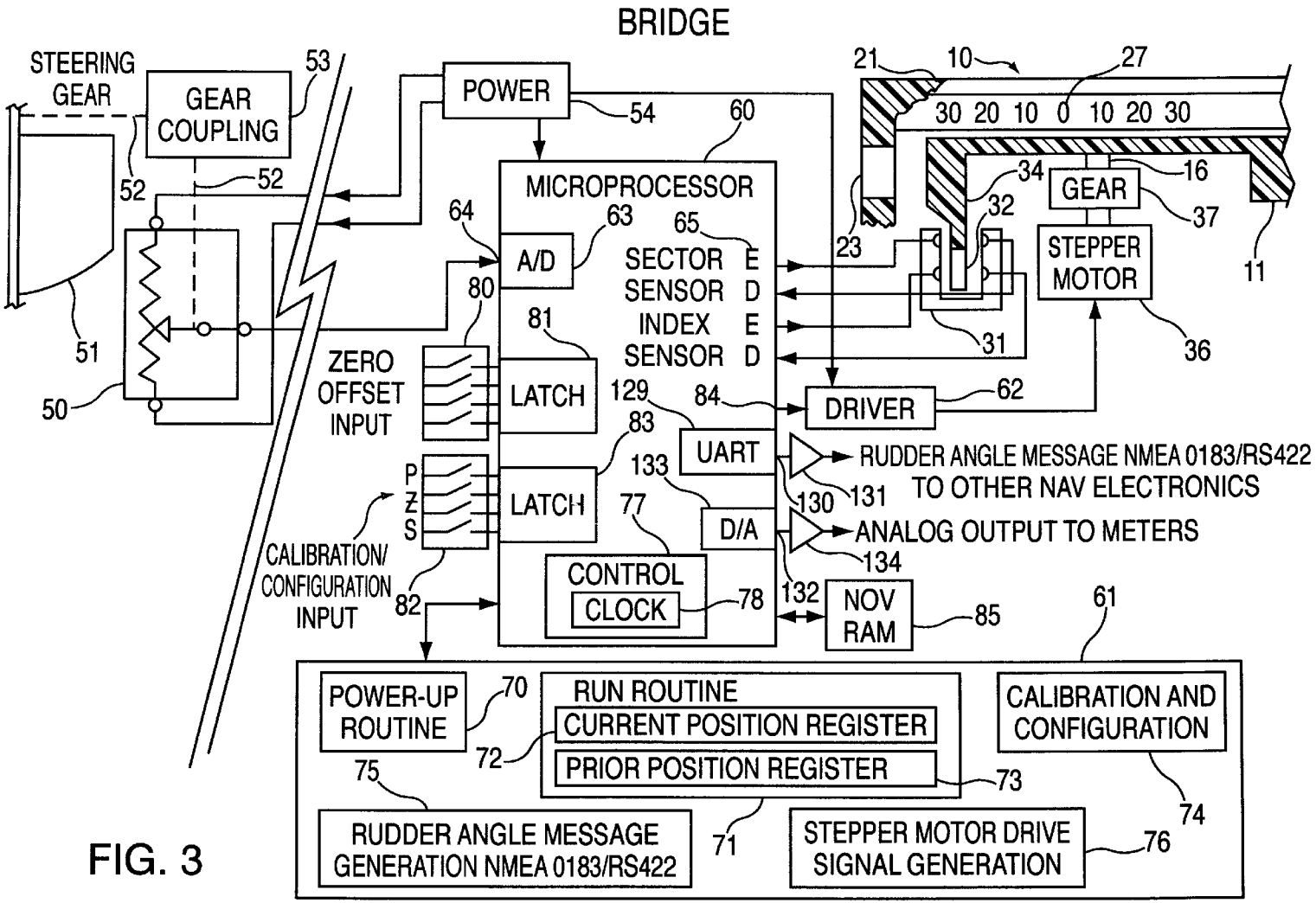
FIG. 3 is a schematic block diagram of the rudder angle indicator system of the present invention including a further representation, partially in section, of the three-faced indicator.

Referring to FIG. 3, where like reference numerals indicate like elements with respect to FIGS. 1 and 2 and with continued reference to FIGS. 1 and 2, the rudder angle indicator system of the present invention is illustrated. A low cost analog rudder angle position sensor implemented as a high quality potentiometer 50 rated for large numbers of cycles is utilized in the system. The potentiometer 50 is coupled to the rudder 51 through appropriate mechanical linkage 52 so as to effect a linear relationship between the motion of the rudder 51 and movement of the wiper of the potentiometer 50. The linkage 52 includes a gear coupling 53 with a multiplication ratio of 3 or 4 so that the wiper of the potentiometer 50 traverses a large section of the potentiometer surface. For example, with a ±35° rudder angle range and a gear ratio of 3, the wiper of the potentiometer 50 traverses ±105°. Utilizing the mechanical multiplication provided by the gear coupling 53 increases the voltage gradient output (volts/degree of movement) and results in less wear in a small section of the potentiometer.

Typically, the potentiometer 50 is excited with ±15 volts dc from a power supply 54. The voltage output from the wiper of the potentiometer 50 will have an associated voltage gradient, such as 0.25 volts/degree, based on the mechanical linkage 52 and the ratio of the gearing 53 utilized to drive the potentiometer 50. Preferably, the linkage 52 is arranged to provide zero volts at the 0° rudder position.

The rudder angle indicator system of FIG. 3 includes the three-faced indicator 10 discussed above and illustrated in detail with respect to FIGS. 1 and 2 including the sector tab 34, index tab 32, sensor assembly 31, stepper motor 36 and gear reduction assembly 37.

A microprocessor 60 together with an associated memory 61 provides motor drive for the stepper motor 36 via a driver circuit 62 and analog input signal conversion from the potentiometer 50 via an analog-to-digital converter 63. The microprocessor 60 and driver circuit 62 receive power from the power supply 54. The microprocessor 60 reads, at an input port 64, the rudder position from the potentiometer 50 via the analog-to-digital converter 63. The microprocessor 60, utilizing input and output ports 65, energizes the emitters 40 and 42 of the index and active sector sensors 33 and 35 and reads the binary values from the sensor detectors 41 and 43 to indicate when the index tab 30 or sector tab 34 on the dial cylinder 11 is blocking the associated sensor. The index tab 30 is sensed by the microprocessor 60 to determine the position of the cylinder 11 for initial alignment purposes and the sector tab 34 is sensed by the microprocessor 60 to determine if the rudder angle indicator dial is in the active sector.

The memory 61 contains software for configuring, calibrating and controlling the system in the various operational phases thereof. Accordingly, the memory 61 includes a power-up routine 70 and a run routine 71. The run routine 71 utilizes a current position register 72 and a prior position register 73. Details of the power-up routine 70 and run routine 71 will be described below with respect to FIGS. 4 and 5, respectively. The memory 61 also includes a calibration and configuration section 74, a rudder angle message generation section 75 and a stepper motor drive signal generation section 76. The microprocessor 60 includes control 77 for controlling various operations of the system to be described. Clock 78 is included for providing timing signals for the system.

A zero offset calibration switch 80 is included to reduce manufacturing tolerances and assembly precision requirements of the alignment of the pointer 13 with respect to the alignment edge 32 and the alignment of the 0° indicium of the scale 26 with the sensor assembly 31. The switch 80 provides a binary coded offset which is read by the microprocessor 60 and stored in a latch 81. The switch 80 introduces a fixed offset, e.g. ±30, to correct any fixed error in the dial positioning processes to be described resulting from manufacturing or assembly process variations.

The calibration and configuration section 74 is utilized to provide a set-up calibration and configuration process to correlate the voltages from the potentiometer 50 to the numeric rudder angle positions on the dial 10. Numerous methods of calibration exist.

One such method is a processor controlled three-point calibration of the potentiometer 50 with processor configuration of the indicator dial. The microprocessor 60 includes a set of push switches 82 for performing the calibration function. Three switches are used to provide the P-port set, S-starboard set, and Z-zero set. Latches 83 are utilized to hold values. With the rudder 51 positioned at 0°, the Z-zero switch is depressed and the microprocessor 60 records the voltage at the analog input 64. The rudder is moved to the largest numeric port position (e.g. 35° or 45°), the P-port switch is depressed and the voltage at the analog input 64 is recorded by the microprocessor 60. A similar process is executed in the starboard direction. The microprocessor 60 then computes and records the voltage gradient. A non-volatile RAM (NOVRAM) memory 85 is included wherein the three-point calibration information is retained. The rudder angle range for a particular installation is identified and set as a parameter in the calibration and configuration section 74 so that the switches 82 can be utilized to configure the system for ±35°, ±45° and other rudder angle indicator ranges.

Alternatively, calibration can be performed by utilizing a fixed voltage gradient with adjustable input and configuration switches. With this process the microprocessor 60 would have a fixed voltage input gradient in volts/degree. A calibration potentiometer (not shown) in the analog input would be utilized to scale the input values to match the indicator. A set of configuration switches would be utilized to identify the rudder angle scale, e.g. ±35° or ±45°, that is being utilized. With this approach, the potentiometer 50 should align such that zero volts is provided when the rudder 51 is at zero degrees.

The stepper motor drive signal generation section 76 generates the standard signals for driving the stepper motor 36 through a predetermined number of steps in a controlled direction. The waveforms for driving a stepper motor and the procedures for generating the waveforms are well known. Furthermore, microprocessors are commercially available that directly provide stepper motor signals such as four phase unipoler stepper motor waveforms (e.g. Motorola processor family 68332). The stepper motor drive signals are applied at an output port 84 of the microprocessor 60 to control the driver circuitry 62. The driver circuitry 62 may comprise power transistor drivers to energize the input lines of the stepper motor 36 in response to the drive signals generated by the software 76. The stepper motor 36 is driven a number of steps in a controlled direction in accordance with the rudder angle position data received at the input port 64 as well as in response to the processes of the power-up routine 70 and the run routine 71 in a manner to be described.

In the rudder angle indicator system, two operational phases are denoted as the power-up phase and the run phase. In the power-up phase, the alignment edge 32 is aligned with the index sensor 33 and the dial position is corrected in accordance with the zero offset entered into the switches 80. In the run phase, after dial alignment, the microprocessor 60 samples the rudder position from the potentiometer 50 at, for example, a 10 Hz rate by reading the A/D converter 63 at the port 64. Based on the polarity and magnitude of any rudder angle change between samples, the microprocessor 60 computes the direction and number of step signals to be issued to the stepper motor 36. In performing the computation the microprocessor 60 applies the appropriate offset and scale factor corrections obtained from the calibration process described above with respect to the switches 82 and converts the voltage value into a rudder angle signal for the stepper motor 36 using the calibrated voltage gradient scaling (volts/degree). Thus, the microprocessor 60 drives the stepper motor 36 to move the dial cylinder 11 to the proper position to indicate the numeric value of the position of the rudder 51.

Figure 4:
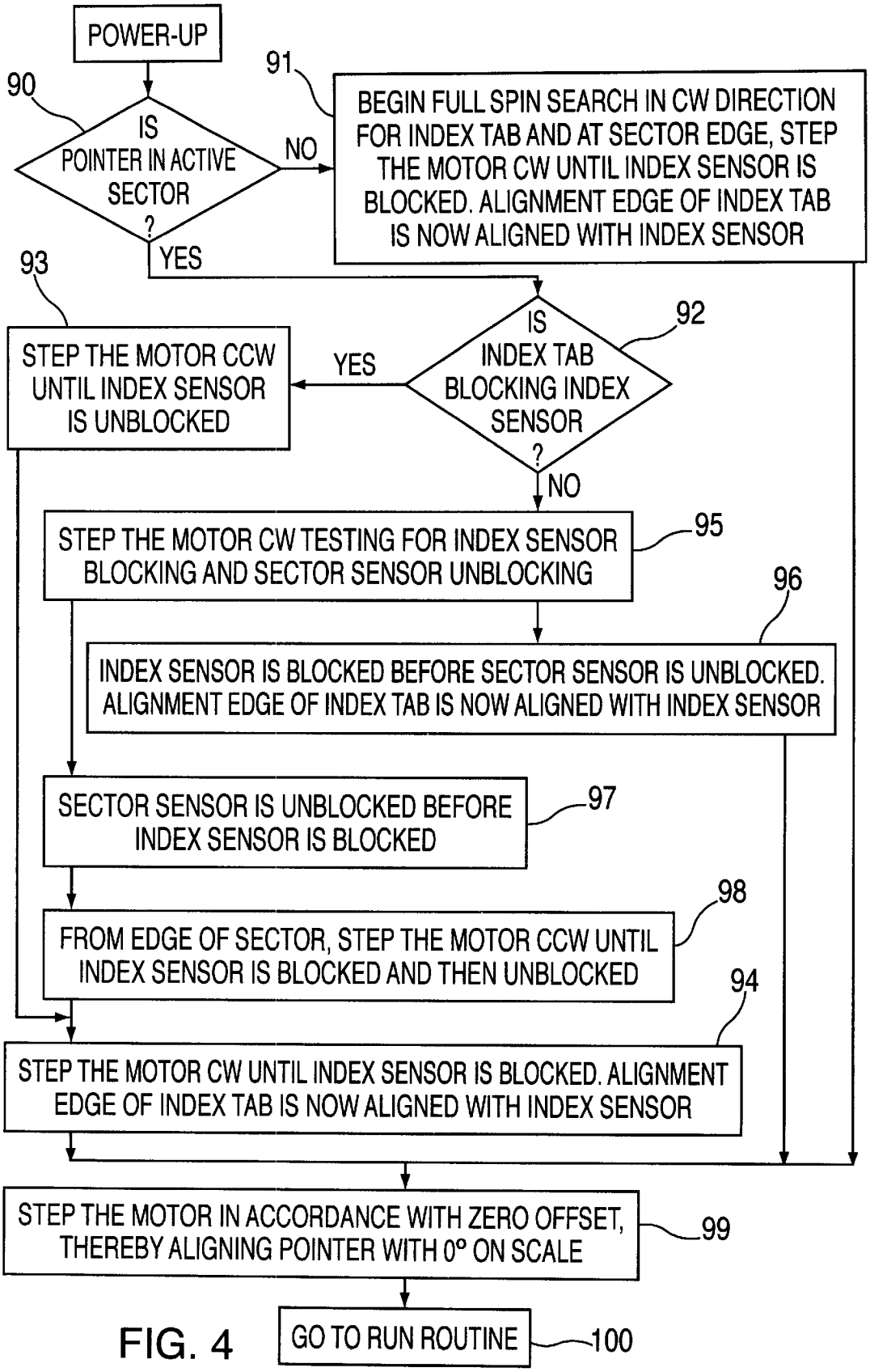
FIG. 4 is a control flow chart of the power-up routine of FIG. 3.

Referring to FIG. 4, with continued reference to FIGS. 1–3, an operational flow chart of the power-up routine 70 is illustrated. It will be noted in the power-up routine that the final alignment of the alignment edge 32 of the index tab 30 with the index sensor 33 is approached uniformly from the same direction of rotation of the cylinder 11, e.g. clockwise (CW).

At a block 90, the microprocessor 60 determines if the dial pointer is in the active sector. The microprocessor 60 makes this determination by detecting the blocked (binary 0) or unblocked (binary 1) status of the active sector sensor 35. If the pointer is not in the active sector, as determined by the unblocked status of the active sector sensor 35, the control 77 of the microprocessor 60 takes the NO branch from the block 90 to a block 91.

At the block 91, a full spin search for the index tab 30 is commenced. The search is performed in the CW direction so that the alignment edge 32 of the index tab 30 is encountered by the index sensor 33 in the CW direction for uniformity of alignment processing. While performing the spin search, the sector sensor 35 is monitored to determine when the active sector edge is encountered. When encountering the active sector edge, the stepper motor 36 is stepped in the CW direction until the index sensor 33 is blocked. When this occurs, the alignment edge 32 is appropriately aligned with the index sensor 33.

Alternatively, the block 91 may be implemented by slewing the stepper motor 36 in the CW direction until the index sensor 33 indicates that the index tab 30 has been encountered. If the alignment edge 32 of the index tab 30 is overshot, the stepper motor 36 is controlled in direction until the alignment edge 32 of the index tab 30 approaches the index sensor 33 from the CW direction and blocks the sensor. When this occurs, the alignment edge 32 is appropriately aligned with the index sensor 33.

If, at the block 90, the dial pointer is in the active sector, as defined by the sector tab 34, the YES branch from the block 90 is taken to a block 92. The processor 60 determines that the pointer is in the active sector by detecting the blocked status of the sector sensor 35. At the block 92, the microprocessor 60 tests the index sensor 33 to determine if it is blocked by the index tab 30. If so, the YES branch is taken from the block 92 to a block 93 whereat the motor 36 is stepped in the counterclockwise (CCW) direction until the index sensor 33 is unblocked.

When, at the block 93, the index sensor 33 becomes unblocked, control proceeds to a block 94 whereat the motor 36 is stepped in the CW direction until the index sensor 33 is again blocked by the index tab 30. When this occurs, the alignment edge 32 is appropriately aligned with the index sensor 33.

If, at the block 92, the index tab 30 is not blocking the index sensor 33, the NO branch from the block 92 is taken to a block 95. At the block 95, the motor 36 is stepped in the CW direction while the microprocessor 60 tests for the index sensor 33 changing from the unblocked state to the blocked state and the sector sensor 35 changing from the blocked state to the unblocked state, whichever event should occur first.

If, at the block 95, the index sensor 33 is first blocked, control enters a block 96 whereat the microprocessor 60 has detected that the index sensor 33 has transitioned from the unblocked state to the blocked state before the sector sensor 35 has changed state. Thus, at the block 96, the alignment edge 32 is appropriately aligned with the index sensor 33.

If, at the block 95, the sector sensor 35 is first unblocked, control proceeds to a block 97 whereat the microprocessor 60 has detected that the sector sensor 35 has transitioned from the blocked state to the unblocked state before the index sensor 33 has changed state. Thus, at the block 97, an edge of the sector tab 34 is positioned at the sector sensor 35. Control proceeds to a block 98 whereat, from the edge of the sector tab 34, the motor 36 is stepped in the CCW direction until the microprocessor 60 detects that the index sensor 33 becomes blocked and then unblocked.

At this point in the processing, the alignment edge 32 of the index tab 30 has just unblocked the index sensor 33. Accordingly, control proceeds to the block 94 at which the motor 36 is stepped in the CW direction until the index sensor 33 is blocked. The alignment edge 32 of the index tab 30 is, therefore, now appropriately aligned with the index sensor 33.

When, at the block 91, 94 or 96, the alignment edge 32 of the index tab 30 is aligned with the index sensor 33, control proceeds to a block 99 whereat the motor 36 is stepped in a direction and for a displacement in accordance with the zero offset stored in the latch 81. The microprocessor 60 reads the zero offset from the latch 81, converts the offset into motor steps utilizing the stepper motor drive signal generation section 76 and adjusts the dial position for the offset. Thus, at the block 99, the pointers 12–14 are aligned with the respective 0° indicia of the scales 25–27.

Once the power-up process of FIG. 4 is completed, control 77 of microprocessor 60 proceeds to the run routine as indicated at a block 100.

Although predetermined directions such as CW and CCW have been designated in FIG. 4, it is appreciated that these rotational directions of the stepper motor 36 are arbitrary and can be interchanged with respect to each other. If, in FIG. 4, CW and cCw are interchanged, the routine will seek the edge of tab 30 opposite the edge 32 for alignment. In this case, the zero offset 80 is adjusted to compensate for the displacement from zero. It is thus appreciated that either edge of the index tab 30 may be used for alignment. The edge nearest to the pointer centerline is preferred to minimize the offset correction. In practice, one edge is selected and the algorithm is defined to search for that edge.

With respect to block 90 of FIG. 4, it is appreciated that during power-down, the rudder angle indicator dial will almost always remain in the active area and the microprocessor 60 can immediately determine this condition at power-up utilizing the sector tab 34 and sector sensor 35. As seen from blocks 92–98 of FIG. 4, the microprocessor 60 is then only required to step the dial through a limited portion of the active sector in order to effect initial power-up alignment. The use of the sector tab 34 and sector sensor 35 greatly enhances the start-up procedures of the display compared to the full 360° spin that would be required without these aspects of the invention. Generally, only when the dial is moved out of the active sector for maintenance, damage or repair, for example, will a full spin be required. When the microprocessor 60 detects, at power-up, that the dial is in the active area, the sector tab 34 and sector sensor 35 permit the microprocessor 60 to perform a rapid search for the index tab over the active dial area.

As well as significantly enhancing the speed of the start-up search for the index tab, the use of the sector tab 34 and sector sensor 35 also greatly enhance the user's perception of the display. In the absence of this aspect of the invention, a full 360° spin of the dial would always be required at start-up. Normally, as discussed above, at start-up, the pointers 12–14 would be located within the view windows 22–24 with respect to the scales 25–27 at some arbitrary position. Since the direction of spin in the full spin search is arbitrary, the pointers 12–14 would often disappear from the view windows and at some significant time later reappear from the opposite edges of the view windows before the zero alignment occurs. This is an undesirable perception for the display.

At start-up, utilizing the invention, the pointers visible in the view windows will often immediately step to the 0° indicia on the scales. At worst, however, the pointers will move away from the 0° indicia toward an edge of the display windows and then back to the 0° indicia to effect alignment. The processing of blocks 90 and 92–99 of FIG. 4 may be considered as creating a virtual stop for the pointers 12–14 at the edges of the viewing windows 22–24. With this arrangement, the pointers 12–14 will normally always be visible within the viewing windows during both power-up and power-down conditions of the display.

Figure 5:
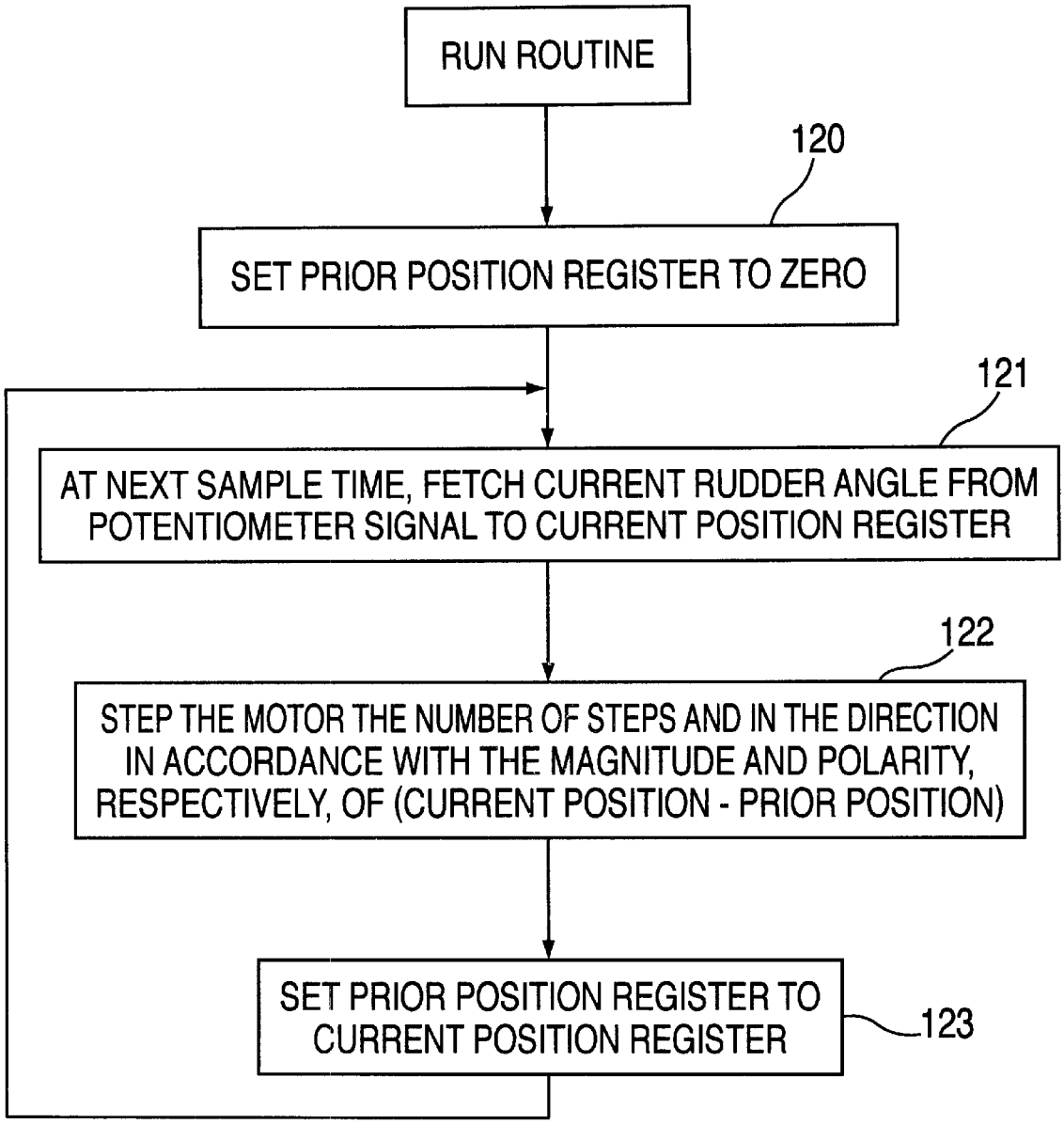
FIG. 5 is a control flow chart of the run routine of FIG. 3.

Referring to FIG. 5, with continued reference to FIGS. 1–3, an operational flow chart of the run routine 71 is illustrated. At a block 120, the prior position register 73 is set to zero since the indicator dial was initialized to 0° during the power-up phase of operation.

During the operational run phase, as discussed above, the rudder angle position from the A/D converter 63 is sampled by the microprocessor 60 at, for example, a 10 Hz rate. The clock 78 provides the timing for the sampling control. At a block 121, at the next sample time, the current rudder angle provided by the signal from the potentiometer 50 is fetched to the current position register 72. At a block 122, the stepper motor 36 is positioned a number of steps and in a direction in accordance with the magnitude and polarity, respectively, of (current position-prior position). The current position and prior position values are taken from the current position register 72 and prior position register 73, respectively. After all of the step signals have been issued to the stepper motor 36 required to position the cylinder 11 from the prior position to the current position, control 77 proceeds to a block 123. At the block 123, the prior position register 73 is set to the value in the current position register 72. Thereafter, control returns to the block 121 to process the next rudder angle position sample.

The microprocessor 60 computes the rudder angular position data from the input provided by the potentiometer 50 applying the configuration, calibration and scale factor corrections previously discussed and accordingly drives the rudder angle dial to the proper position. The microprocessor 60 continues execution of the loop defined by the blocks 121–123 until termination of the run phase by, for example, a power-down procedure.

As discussed above, the microprocessor 60 drives the stepper motor 36 open loop where the actual movement of the dial cylinder 11 is not monitored by the microprocessor. Under both static and dynamic conditions, when a step command is issued by the microprocessor 60, the rotor of the stepper motor 36 must deflect the proper amount. As is known, the ability of a stepper motor to position a load and to reliably maintain the position is defined by the motor dynamic, holding and residual torques. The load driven by the stepper motor 36 is comprised of the gear reduction assembly 37 and the cylinder 11. As previously described, the reduction gear train 37 is utilized to enhance dial resolution. A stepper motor is used that provides a coarse step and the gear reduction assembly 37 advantageously permits a small sized stepper motor to be utilized. The stepper motor 36 is selected with appropriate torque specifications to ensure that steps are effected without loss of position and to ensure that no steps are missed so that the stepper motor 36 can be driven open loop after the initial 0° position determination is effected.

Referring again to FIG. 3, the microprocessor 60 provides a rudder angle message in the standard NMEA 0183 format from an output port 130 via a standard UART (Receiver/Transmitter) 129. The messages are RS422 serial in ASCII format and are generated by conventional software in the section 75. The microprocessor 60 transmits the serial message conveying current rudder angle through appropriate driver amplifiers 131 to other navigational electronics on the ship.

The microprocessor 60 also outputs, via a port 132, a scaled analog value of rudder angle via a digital-to-analog converter 133. This signal is buffered at amplifiers 134 and utilized to drive small analog meter movements located at other stations on the ship.

It is appreciated from the foregoing that the rudder angle indicator system of the present invention provides a large, easy to read indication of rudder angle on the bridge and further provides ancillary rudder angle indicators located at various positions on the ship. The rudder angle sensor (potentiometer 50) and display 10 of the system are physically and electrically separate from other navigation sensor so as to provide an independent monitoring system.

The disclosed embodiment combines an accurate, low cost potentiometer position sensor with a microprocessor controlled, open loop driven, stepper motor with inexpensive optical sensors for providing a large three-faced rudder angle indicator display. The potentiometer 50 is one of the lowest cost devices to sense the absolute position of the rudder. The index and sector tabs with an open loop stepper motor drive provides a low cost, reliable system to position the large rudder angle dial. The low cost components comprising the potentiometer rudder angle sensor, open loop driven stepper motor, low cost optical sensors together with the economical three-faced rudder angle indicator construction combine to provide an efficacious rudder angle indicator system that is significantly more cost effective than known prior art systems, particularly those utilizing the large three-faced rudder angle indicator.

While the invention has been described in its preferred embodiment, it is to be understood that the words which have been used are words of description rather than of limitation and that changes within the purview of the appended claims may be made without departure from the true scope and spirit of the invention in its broader aspects.

What is claimed is:

1. A system for providing a position indication of the position of a member, said position being in a position range through which said member may be moved, said system comprising, sensor means coupled to said member for providing a position signal in accordance with the position of said member, indicator means for providing said position indication in an active sector of said indicator means, said active sector corresponding to said position range, drive means for driving said indicator means open loop in response to said position signal so as to drive said indicator means to provide said position indication, initializing means for activating said drive means in accordance with first and second initializing procedures so as to drive said indicator means to a predetermined initial indication, said initial indication providing a reference for said position indication, and active sector means for detecting when said indicator means is and is not positioned in said active sector and providing an active sector signal in accordance therewith, said initializing means being responsive to said active sector signal for activating said drive means in accordance with said first initializing procedure when said indicator means is positioned in said active sector and in accordance with said second initializing procedure when said indicator means is not positioned in said active sector.

2. The system of claim 1 wherein said initializing means is operative for activating said drive means in accordance with said first initializing procedure by driving said indicator means within said active sector to locate said predetermined initial indication.

3. The system of claim 2 wherein said initializing means includes means responsive to said active sector signal for maintaining said indicator means within said active sector when performing said first initializing procedure.

4. The system of claim 1 wherein said initializing means is operative for activating said drive means in accordance with said second initializing procedure by driving said indicator means to said active sector and then to said predetermined initial indication.

5. The system of claim 1 wherein said member comprises the rudder of a marine vehicle, said position of said member comprising rudder angle, said position range comprises a rudder angle range through which said rudder may be moved, said position indication comprises a rudder angle indication, and said sensor means comprises a potentiometer coupled to said rudder for providing a rudder angle signal in accordance with said rudder angle.

6. The system of claim 5 wherein said indicator means comprises a rudder angle indicator for providing said rudder angle indication in said active sector corresponding to said rudder angle range.

7. The system of claim 6 wherein said drive means comprises a stepper motor for positioning said rudder angle indicator open loop in response to said rudder angle signal so as to position said rudder angle indicator to provide said rudder angle indication.

8. The system of claim 7 wherein said rudder angle indicator comprises a rudder angle display having at least one display face for providing said rudder angle indication, said display including a rotatable cylindrical member, at least one rudder angle scale and at least one scale pointer, one of said at least one scale and said at least one pointer being disposed on said rotatable cylindrical member so that said at least one scale and said at least one pointer rotate with respect to each other, said at least one scale and said at least one pointer comprising said at least one display face, said stepper motor being coupled to said rotatable cylindrical member for positioning said rotatable cylindrical member open loop in response to said rudder angle signal so as to provide said rudder angle indication.

9. The system of claim 8 wherein said active sector is defined by said rudder angle scale, said active sector means including a sector tab associated with said rotatable cylindrical member for defining said active sector, and a sector sensor positioned with respect to said rotatable cylindrical member so as to detect said sector tab, said sector sensor providing said active sector signal in accordance with detecting and not detecting said sector tab.

10. The system of claim 9 wherein said sector sensor comprises an optical interrupter sensor.

11. The system of claim 9 wherein said initializing means includes an index tab associated with said rotatable cylindrical member, and an index sensor positioned with respect to said rotatable cylindrical member so as to detect said index tab, said index tab and said index sensor positioned with respect to said scale and said pointer so as to define said predetermined initial indication, said initializing means being operative for activating said stepper motor to drive said rotatable cylindrical member until said index sensor detects said index tab, thereby positioning said rotatable cylindrical member to said predetermined initial indication.

12. The system of claim 11 wherein said index sensor comprises an optical interrupter sensor and said predetermined initial indication comprises the 0° rudder angle indicium of said scale.

13. The system of claim 12 wherein said initializing means is operative for activating said stepper motor in accordance with said first initializing procedure by driving said rotatable cylindrical member within said active sector, as controlled by said sector tab detected by said sector sensor, to detect said index tab with said index sensor.

14. The system of claim 13 wherein said initializing means includes means responsive to said active sector signal for maintaining said rotatable cylindrical member within said active sector when performing said first initializing procedure by detecting an edge of said sector tab by said sector sensor.

15. The system of claim 14 wherein said initializing means is operative for activating said stepper motor in accordance with said second initializing procedure by driving said rotatable cylindrical member to said active sector by detecting said sector tab with said sector sensor and then to said predetermined initial indication by detecting said index tab with said index sensor.

16. The system of claim 15 further comprising processor means including an analog-to-digital converter, said potentiometer providing an analog signal in accordance with rudder angle, said processor means receiving said analog signal through said analog-to-digital converter for generating drive signals for said stepper motor, said processor means further including means for converting said signal received through said analog-to-digital converter into a rudder angle message in an MNEA 0183 format, and said processor means further including a digital-to-analog converter for reconverting said analog signal to provide analog rudder angle signals to rudder angle indicator meters.

17. A low cost rudder angle indicator system for providing a plurality of rudder angle indications of the angular position of the rudder of a marine vehicle, said system comprising potentiometer means coupled to said rudder for providing a rudder angle signal in accordance with the position of said rudder, a large rudder angle display having a plurality of display faces for providing said plurality of rudder angle indications, respectively, said display adapted for mounting in a predominantly viewable location on the bridge of said marine vehicle, said display including a rotatable cylindrical member, a plurality of rudder angle scales and a plurality of scale pointers, one of said plurality of scales and plurality of pointers being disposed on said rotatable cylindrical member so that said plurality of scales and said plurality of pointers rotate with respect to each other, said plurality of scales and said plurality of pointers comprising said plurality of display faces, respectively, a stepper motor coupled to said rotatable cylindrical member for positioning said rotatable cylindrical member open loop in response to said rudder angle signal so as to provide said plurality of rudder angle indications, and initializing means for driving said stepper motor to position said rotatable cylindrical member to a predetermined initial position, said initial position providing a reference for said rudder angle indications.

18. The system of claim 17 wherein said angular position of said rudder is in a rudder angle range through which said rudder may he moved, said display provides each of said plurality of rudder angle indications in an active sector of said display, said active sector corresponding to said rudder angle range, said initializing means comprises means for driving said stepper motor in accordance with first and second initializing procedures so as to position said rotatable cylindrical member to said predetermined initial position, said system further comprising active sector means for detecting when said rotatable cylindrical member is and is not positioned in said active sector and providing an active sector signal in accordance therewith, said initializing means being responsive to said active sector signal for driving said stepper motor in accordance with said first initializing procedure when said rotatable cylindrical member is positioned in said active sector and in accordance with said second initializing procedure when said rotatable cylindrical member is not positioned in said active sector.

19. The system of claim 18 wherein said initializing means is operative for driving said stepper motor in accordance with said first initializing procedure by positioning said rotatable cylindrical member within said active sector to locate said predetermined initial position.

20. The system of claim 19 wherein said initializing means includes means responsive to said active sector signal for maintaining said rotatable cylindrical member within said active sector when performing said first initializing procedure.

21. The system of claim 18 wherein said initializing means is operative for driving said stepper motor in accordance with said second initializing procedure by driving said rotatable cylindrical member to said active sector and then to said predetermined initial position.

22. The system of claim 18 wherein said active sector is defined by said rudder angle scales, said active sector means including a sector tab associated with said rotatable cylindrical member for defining said active sector, and a sector sensor positioned with respect to said rotatable cylindrical member so as to detect said sector tab, said sector sensor providing said active sector signal in accordance with detecting and not detecting said sector tab.

23. The system of claim 22 wherein said sector sensor comprises an optical interrupter sensor.

24. The system of claim 22 wherein said initializing means includes an index tab associated with said rotatable cylindrical member, and an index sensor positioned with respect to said rotatable cylindrical member so as to detect said index tab, said index tab and said index sensor positioned with respect to said scales and said pointers so as to define said predetermined initial position, said initializing means being operative for activating said stepper motor to drive said rotatable cylindrical member until said index sensor detects said index tab, thereby positioning said rotatable cylindrical member to said predetermined initial position.

25. The system of claim 24 wherein said index sensor comprises an optical interrupter sensor and said predetermined initial position comprises a 0° rudder angle indicium of said scales.

26. The system of claim 25 wherein said initializing means is operative for activating said stepper motor in accordance with said first initializing procedure by positioning said rotatable cylindrical member within said active sector, as controlled by said sector tab detected by said sector sensor, to detect said index tab with said index sensor.

27. The system of claim 26 wherein said initializing means includes means responsive to said active sector signal for maintaining said rotatable cylindrical member within said active sector when performing said first initializing procedure by detecting an edge of said sector tab by said sector sensor.

28. The system of claim 27 wherein said initializing means is operative for activating said stepper motor in accordance with said second initializing procedure by driving said rotatable cylindrical member to said active sector by detecting said sector tab with said sector sensor and then to said predetermined initial position by detecting said index tab with said index sensor.

29. The system of claim 28 further comprising processor means including an analog-to-digital converter, said potentiometer providing an analog signal in accordance with rudder angle, said processor means receiving said analog signal through said analog-to-digital converter for generating drive signals for said stepper motor, said processor means further including means for converting said signal received through said analog-to-digital converter into a rudder angle message in an MNEA 0183 format, and said processor means further including a digital-to-analog converter for reconverting said analog signal to provide analog rudder angle signals to rudder angle indicator meters.

* * * * *